United States Patent [19]

Raskin

[11] 4,003,155

[45] Jan. 18, 1977

[54] MODEL AIRCRAFT AND PACKAGE

[75] Inventor: Jef Raskin, Brisbane, Calif.

[73] Assignee: Jef's Friends, Brisbane, Calif.

[22] Filed: Apr. 7, 1975

[21] Appl. No.: 565,766

[52] U.S. Cl. ..... 46/79
[51] Int. Cl.[2] ..... A63H 27/00
[58] Field of Search ..... 46/76 R, 78, 79–81

[56] References Cited

UNITED STATES PATENTS

| | | | |
|---|---|---|---|
| 2,210,642 | 8/1940 | Thompson | 46/79 |
| 2,637,139 | 5/1953 | Harris | 46/76 R |
| 3,221,441 | 12/1965 | Shapiro | 46/79 |
| 3,858,349 | 1/1975 | Mc Clendon | 46/79 |
| 3,884,092 | 5/1975 | Ditto | 46/79 |

*Primary Examiner*—G.E. McNeill
*Assistant Examiner*—Robert F. Cutting
*Attorney, Agent, or Firm*—Ronald E. Grubman

[57] ABSTRACT

A model aircraft is constructed from a material having a plurality of parallel channels therein, e.g., corrugated cardboard. The aircraft is formed so that all of the various side, top, and bottom panels are gently curved over the length of the fuselage to provide a stressed fuselage which is aerodynamically sound, attractive, and extremely strong. A pair of wings are constructed so that each wing has span-wise corrugations along which bends or folds are made to produce an airfoil, e.g., by conforming to the shape of a number of ribs which define the airfoil shape. Dihedral of the wings is provided by a number of spring-like elements such as wires which can be bent and inserted into corrugations in the wings to join the wings at the required dihedral angle while allowing span-wise flexibility of the wings. The wings may be inserted into slots in the fuselage and rest upon a wing saddle therein. In accordance with different embodiments of the invention, alternate wing structures are provided.

All of the parts of the aircraft may be printed upon and stamped from a single large sheet of the material from which the airframe is constructed. Thus, by folding the material to create a number of panels, these may be folded upon one another to produce a simple package suitable for mailing. Advantageously, all of the instructions for assembly as well as assembly illustrations, package design and mailing labels may be printed along with the printing of the aircraft to provide a simple, inexpensive unit for the aircraft.

12 Claims, 9 Drawing Figures

MODEL AIRCRAFT AND PACKAGE

BACKGROUND OF THE INVENTION

In the field of model airplane construction, and in particular in the construction of airframes for radio-controlled, model glider aircraft, it has been traditional to utilize light-weight materials such as balsa wood. In recent years other materials such as plastics and foam have also been employed, but these are not easily workable for the home model builder. It has therefore become of interest to modellers to explore the possibility of constructing airframes from other cheap, resilient materials, such as corrugated cardboard.

There are now known in the art a few models which are constructed primarily of corrugated cardboard. However, presently-available models are generally very crude, utilizing, e.g., channel-shaped fuselage portions which require additional inner supports for strength and rigidity. It has been a difficult problem to construct corrugated wing structures which exhibit both strength and span-wise flexibility, which is especially important if the aircraft is to perform difficult maneuvers. These considerations are especially important for the design of glider aircraft since for good performance such aircraft must have both strength and excellent aerodynamic qualities.

SUMMARY OF THE INVENTION

In accordance with the illustrated embodiments, the present invention provides an airframe for a model aircraft which is constructed almost entirely from a material having a plurality of internal channels, such as corrugated cardboard. The various top, side, and bottom panels of the fuselage are all gently and continuously curved to produce complemtary stresses which provide great rigidity to the fuselage. The wing of the aircraft is constructed in two sections which are held together at a desired dihedral angle. This angle is established by several flexible wires which are bent and inserted into corrugations running spanwise along the wings. Friction between the corrugations and the wing wires serves to provide the tension required to hold the wings together. The wings are inserted into the fuselage and come together on a wing saddle element positioned in the interior of the fuselage.

For good performance, it is especially desirable that the wings exhibit precise and equal amounts of "wash-out." In preferred embodiments of the invention, wash-out is provided by a combination of two factors; first, each wing is formed with a gull-like span-wise taper; then, the convex lift surface of each wing is achieved by bending the wing along several of its corrugations around a set of ribs designed to produce a precise amount of wash-out when the bottom of the ribs are simply aligned, e.g., by a visual alignment.

Other wing configurations utilizing wings having both upper and lower portions consisting of convex or flat corrugated cardboard are shown in addition embodiments. Yet a further embodiment of the invention includes a wing in which single-sided corrugated cardboard is stretched around a set of ribs with the corrugated side outward. This corrugated side may then be laminated with a suitable material, such as Mylar.

In accordance with other aspects of the invention, the entire aircraft may be stamped from a single sheet of material on which is printed the outline of the airframe, assembly instructions, illustrations, decorations, etc. By suitably designing a single sheet, it may include container-type decorations and mailing information such that the sheet may simply be divided into panels which are folded one onto another to form the container for the aircraft. Thus, the airframe and its container may be a single unit.

DESCRIPTION OF THE PREFERRED EMBODIMENTS

Figure 1:
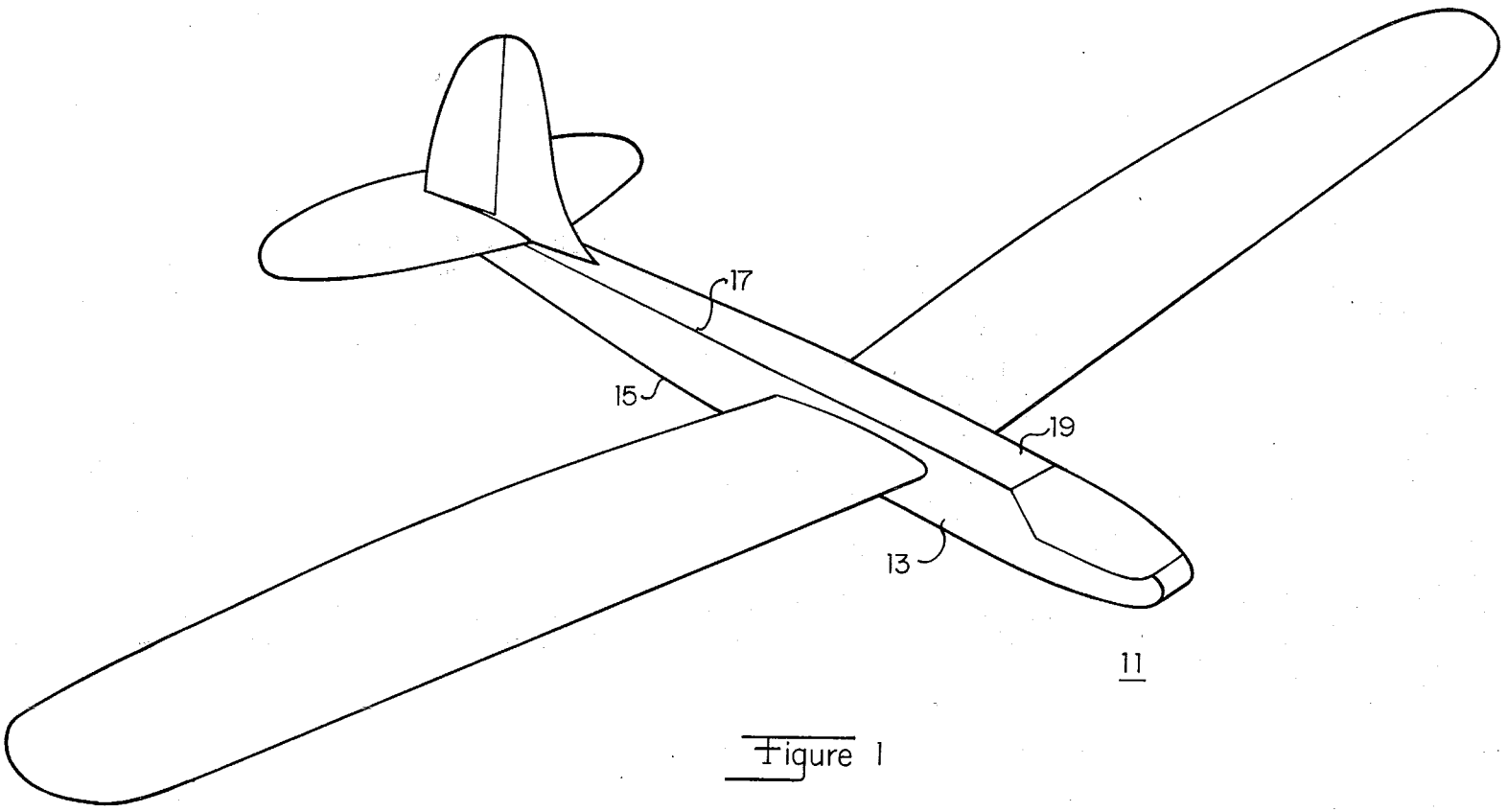
FIG. 1 shows an airframe for a model glider aircraft according to a preferred embodiment.

In FIG. 1 there is illustrated an airframe 11 for a model glider aircraft constructed in accordance with the principles of the present invention. The airframe is preferably constructed of a material having a plurality of internal channels, such as corrugated cardboard or corrugated plastic.

Figure 2:
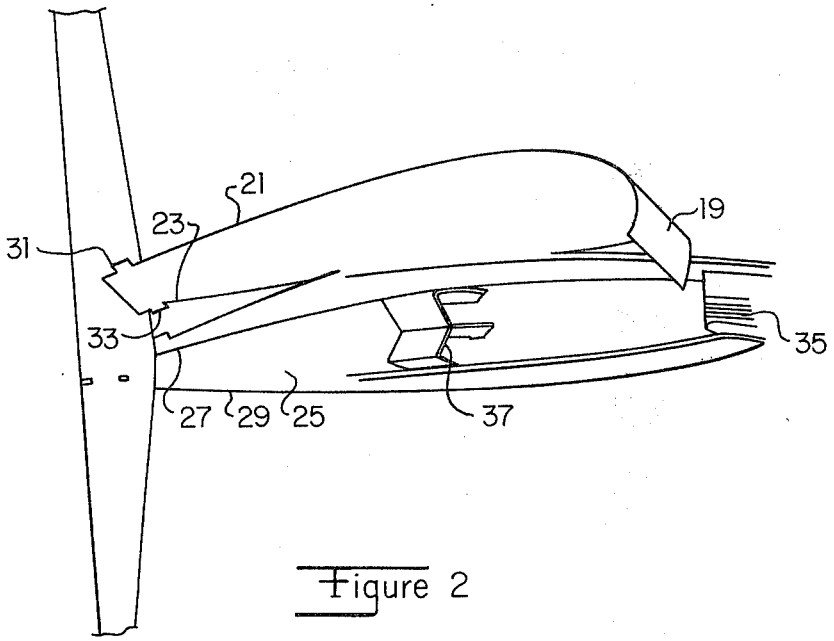
FIG. 2 is an interior view of an airframe showing a wing saddle.

In the figures a fuselage having four sections, a top, a bottom, and two sides is shown, but the principles to be set forth hereinafter may be equally well applied when a greater or lesser number of panels is desired. In the figures the right side of the fuselage is labeled 13 and includes edges labeled 15 and 17. As can be seen from FIG. 1, the edges form a gentle and continuous curve extending the entire length of the fuselage. Thus, a top surface 19 and a bottom surface (not labeled in the figure) when attached to edges 15 and 17 and to corresponding edges of the left side of the fuselage will also display a similar continuous curve. In FIG. 2 it may be seen that top section 19 also includes two edges labeled 21 and 23 which are themselves curved in order that the sides shall similarly conform. Also in FIG. 2 is illustrated a bottom panel 25 including continuously-curved edges 27 and 29. When all of these surfaces are joined together during construction, for example, by applying hot glue or another suitable adhesive, the top, bottom, and side panels are all conformed to a continuous curve running the length of the fuselage. The material is bent below its elastic limit to induce balanced stresses which serve to impart a great rigidity to the airframe. In the preferred embodiment, the corrugations run lengthwise from nose to tail. The above-described construction also has the additional dual advantages of presenting an attractive appearance and providing a good aerodynamic airframe which is of special importance in a glider aircraft. In FIG. 2 there are also illustrated a pair of tabs 31 and 33 which are included on the top surface of the aircraft. During construction, these tabs are positioned in associated slots on the side surfaces of the aircraft to insure simple and precise alignment of the various panels. Also illustrated in FIG. 2 is a nose block element which may consist of a number of pieces of corrugated cardboard glued together to form a solid mass. The top of the fuselage 19 may then be slightly crushed in the vicinity of the nose and bent around the nose block to provide extreme strength for the aircraft in the nose section.

In FIG. 2 a wing saddle 37 is positioned in the interior of the fuselage. This wing saddle preferably consists of a section of corrugated material which is folded upon itself to form an M-shaped unit having three legs which may be positioned in the fuselage by extending slightly into the bottom thereof. The V-shaped top of the saddle provides a seat upon which the wings will rest when inserted into the fuselage through slots in the sides. This procedure will be described in more detail below.

Figure 3:
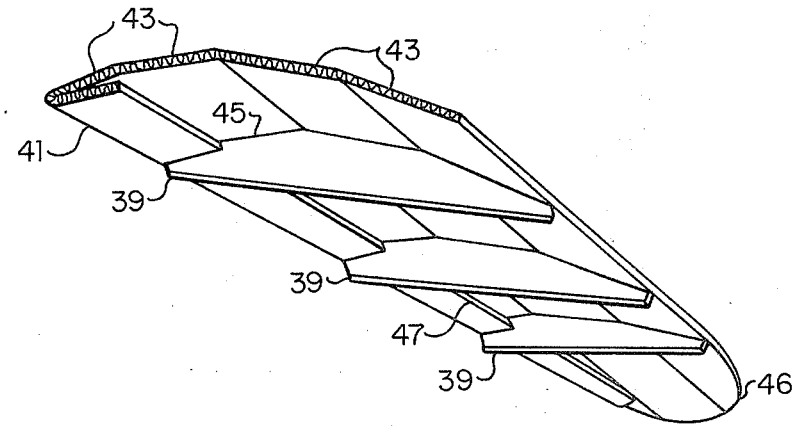
FIG. 3 illustrates an aircraft wing in a preferred embodiment.

In FIG. 3 there are illustrated a number of ribs cut from the corrugated material which are collectively labeled 39. The right-wing, which is illustrated in the figure, has the corrugations running span-wise the length of the wing from the innermost portion to the tip thereof. In preferred embodiments of the invention, the leading edge 41 is folded back upon itself slightly and glued to the underside of the wing, thereby providing additional strength to the wing as well as improving the stall characteristics of the aircraft. The wing assumes a convex airfoil shape through bends performed lengthwise along the corrugation, four typical such bends being collectively labeled 43. These bends coincide with corners on the upper surface 45 of ribs 39 so that when the wing is glued to the ribs it is forced to conform to the rib shape and thereby adopt a convex airfoil configuration.

To optimize flight performance, it is often desirable to provide "wash-out" of an airfoil. More precisely, what is meant by wash-out is that as a function of increasing distance from the center of the wing to the wing tip, the leading edge should acquire an increasing downward rotation with respect to the trailing edge. In accordance with the invention, the trailing edge of the wing 56 is tapered in a gull-like fashion so that when the wing is bent over the ribs the appropriate amount of wash-out is provided. This is automatically provided by shaping the ribs so that when the bottom edge of the rib is simply aligned, for example, visually, or by placing the wing downwardly on a flat surface, the wing taper in conjunction with the wing convexity provides the desired wash-out. Thus, a relatively inexperienced model builder may produce wings having precise and equal amounts of wash-out with a minimum of effort, thereby enabling him to enjoy the benefits of a higher performance aircraft without concomitant difficulties of assembly. It may be noted that once a desired wing convexity is achieved, a skilled model builder may construct wings of different degrees of taper to produce varying amounts of washout.

Figure 4:
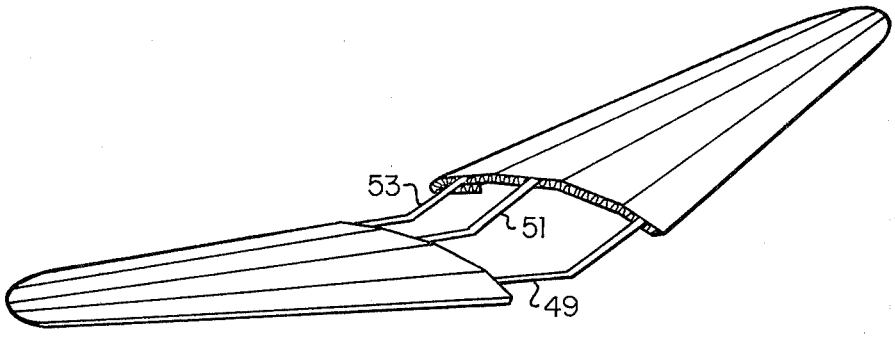
FIG. 4 shows two wings joined by spring-like wing wires to form a dihedral angle.

In many aircraft, particularly those in which control is to be achieved without ailerons (e.g., rudder-only control), it is essential that the wing not be a single flat surface but also include a dihedral angle. In the preferred embodiment, the dihedral is provided by a number of spring-like wires labeled 49, 51 and 53 in FIG. 4. These wires should be constructed of a springy material such as steel which can be bent and will hold the bend but yet retain a good deal of lengthwise flexibility. The diameter of these wires may preferably be chosen to provide a snug fit into the flutes of the corrugation of the wing. The use of these spring-like elements thus serves to define the dihedral of the wings when the wings are forced together to meet at the bend of the wires. The friction between the corrugations and the wires serves to provide the inward tension necessary to hold the wings together. At the same time, however, it is highly desirable that the wings have a good deal of spanwise flexibility to absorb the stresses of acrobatic maneuvers. The use of spring wires according to the invention is advantageous in that the wings are not constrained to be rigid along their length, but will "flap" somewhat during flight, always, however, maintaining a nominal dihedral angle defined by the bend in the wires.

It is possible also to run the elements 49-53 through holes in ribs 39, rather than into the corrugations. This will be particularly desirable in connection with an embodiment of the invention to be described herein in which the wing includes both top and bottom surface elements. Other suitable fittings may also be included on the wings or ribs to affix them to the wing wires. If it is desired to perform extreme aerobatic maneuvers, additional inward tension on the wings may be provided by including rubber bands connecting the two wings (e.g., by affixing these to the innermost rib of each wing). It is an advantage, however, of the simpler construction in which the spring-wire elements are inserted into the corrugations that the wings may be easily separated and removed from the fuselage to facilitate transportation to and from flying sites.

Figure 5:
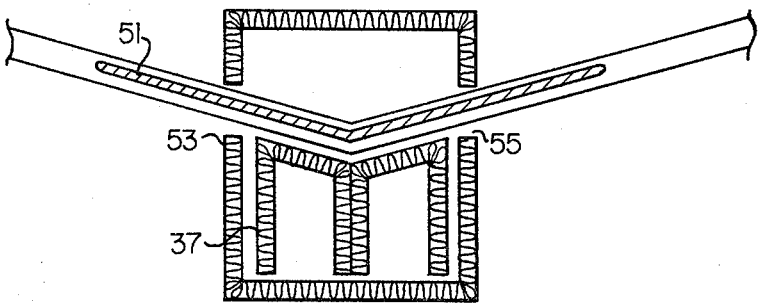
FIG. 5 is a cross-sectional view of an airframe illustrating a wing saddle.

In FIG. 5 wing saddle 37 is illustrated in cross section viewed from the nose of the aircraft. It can be seen that the wings are inserted into the sides of the fuselage through a pair of slots 53 and 55. Wing wire 51 is shown to illustrate how a dihedral angle is determined by the shape of the wire. This dihedral angle conforms to the shape of the top surface of wing saddle 37. In accordance with the invention, the wings are not joined to the fuselage but are inserted through slots 53 and 55 and are seated on wing saddle 37. The wings therefore pivot about the wing slots causing upward forces exerted on the wing in flight to be rotated through the pivot points and cantilevered into a downward force upon wing saddle 37. This downward force is then transferred to the fuselage. The wings may therefore absorb large flying forces without exerting crushing forces on the sides of the fuselage. Additionally, in the unhappy event of a crash landing, construction according to the aforementioned principles of the invention allows the wings to slide forward and also outwardly along the spring wires rather than rigidly absorbing the crash forces. Airplanes constructed in accordance with these principles have survived numerous crash landings with very little damage to the wings or fuselage.

Figure 6A:
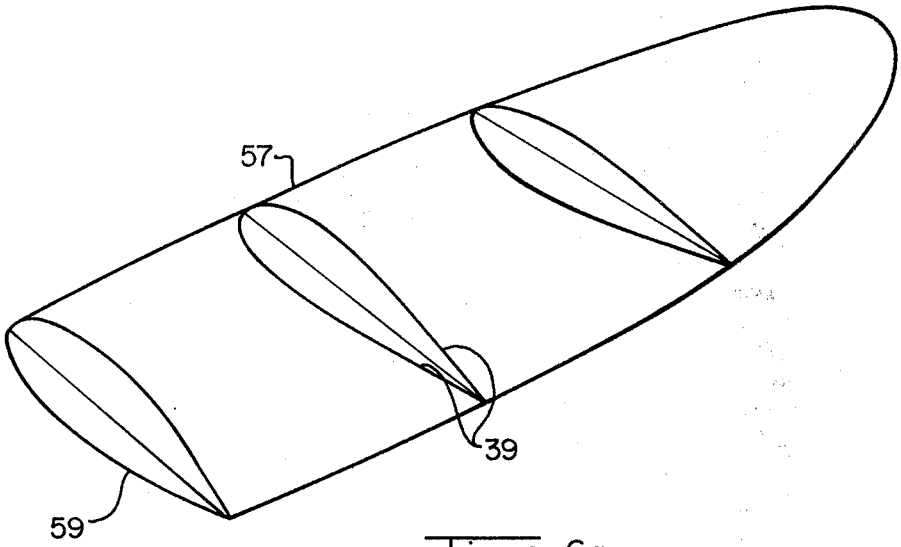
FIGS. 6*a* and 6*b* show other preferred embodiments of model aircraft wings.

In FIG. 6a is illustrated a wing having top and bottom curved surfaces 57 and 59 respectively. Such a wing is desirable for high performance aircraft, since drag is reduced if there are no exposed wing ribs. The wing here illustrated may be constructed by forming a pair of wings as described in FIG. 3, and joining the pair together by, e.g., glueing together pairs of wing ribs 39 along their flat bottom surfaces. Preferably, the outermost ribs are eliminated, and the two wing halves are compressed and glued together along the leading and trailing edges. This creates a stressed wing which is very strong and includes a precise amount of wash-out determined only by the rib shape and wing profile.

Figure 6B:
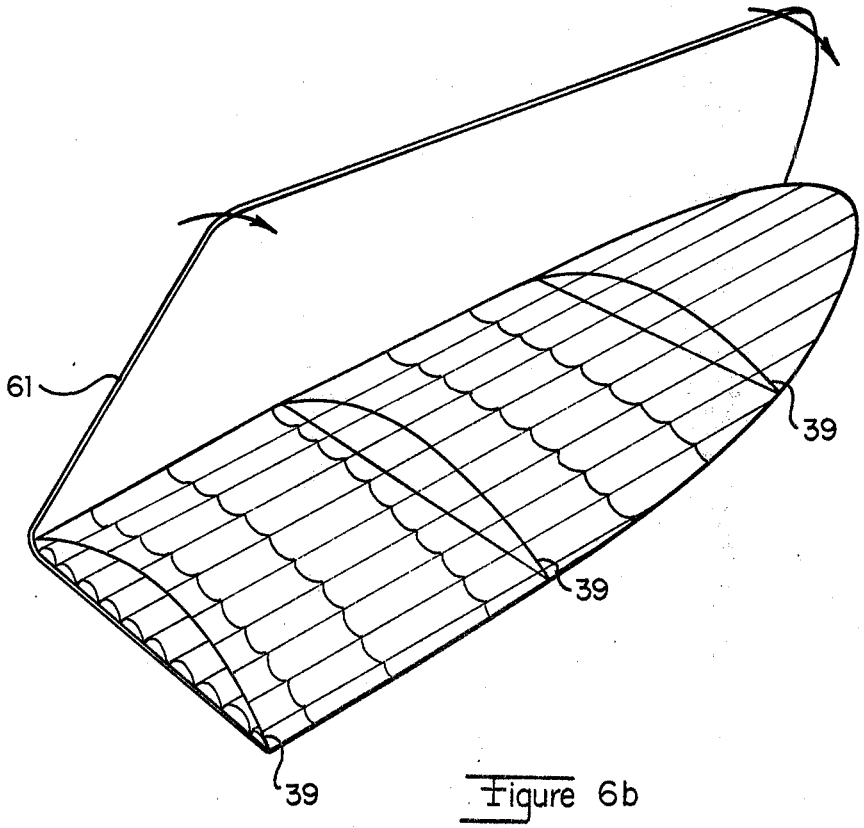

In FIG. 6b there is shown a set of wing ribs 39 around which is wrapped a wing formed from a material such as single-sided corrugated cardboard. In this embodiment, the open corrugations face outwardly away from the ribs, so that the corrugated cardboard can be easily wrapped therearound. To complete the wing structure, an outer covering 61 of a light material such as Mylar or cloth or plastic is stretched around the open corrugations. This construction makes possible the simple fabrication of relatively complicated wing structures.

Figure 7A:
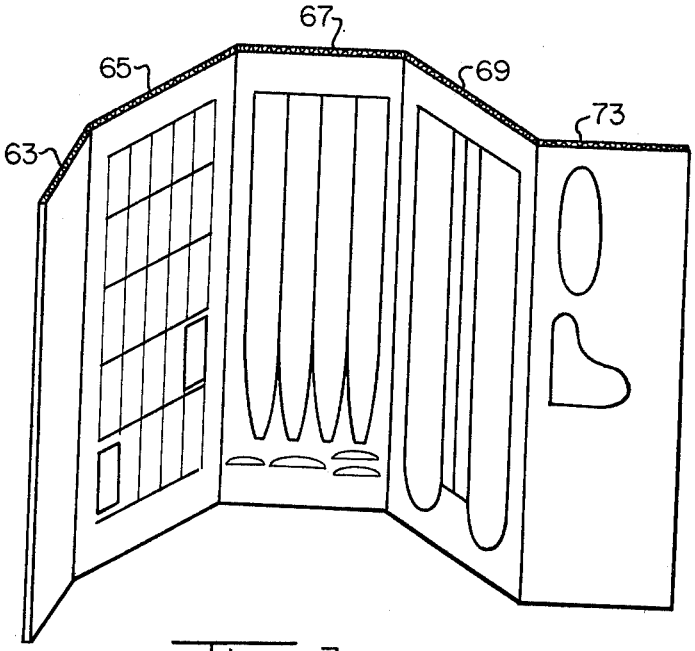
FIGS. 7*a* and 7*b* illustrate how an aircraft may be integrated into a package according to the invention.
Figure 7B:
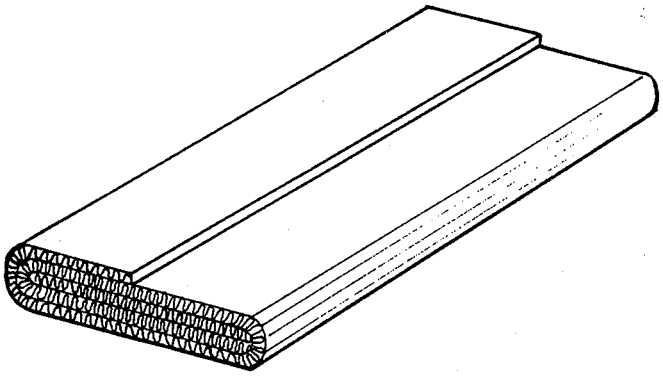

In FIG. 7a there is illustrated a single piece of construction material for a model aircraft. In accordance with an aspect of the invention, the various parts of an airframe are "stamped" onto the material which is then folded upon itself to provide a package suitable for mailing and display. The concept to be described in more detail herein may be adapted to many materials from which an airframe is to be fabricated; some examples are paper, cardboard, corrugated cardboard, foamcore, honeycomb core, sheet plastics, sheet foam plastic, "corrugated" plastic and sheet aluminum. In FIG. 7 the panel has been folded at four places to form five panels labeled 63, 65, 67, 69 and 73. The folds are shown as being made lengthwise along the corrugations. The various parts of the aircraft are laid out on the panels in such manner that for each section, e.g., the wings, the corrugations run in the appropriate direction to give desired strength and/or flexibility. Such parts are illustrated in panels 67, 69 and 73. When packaging is done according to these principles, it is possible to effect an enormous saving in costs of labor as well as packaging materials themselves. For example, on panel 65 there is illustrated a number of columns of printing as well as diagrams which may comprise the assembly instructions for the aircraft. Thus, it is not necessary to print separate assembly instructions for the hobbyist, but rather these can be printed in one operation along with the outline of the aircraft itself. Additionally, if it is desired that the aircraft be sold predecorated, these decorations may also be included in the same single printing run. Furthermore, it is a simple matter to print the design of an exterior package and the mailing labels also in the same print run. Thus, when the package is folded, for example, as illustrated in FIG. **7*b***, it is immediately prepared for mailing or other distribution. All of the printing may be accomplished by any of a number of means known to those skilled in the art. For example, a rubber printing mat may be employed, or a silk screen printing process may be used, or a laminated pre-printed material may be affixed to a one-sided corrugated sheet. Subsequent to the printing, the flat sheet may be die cut by means of metal dies in the same manner as in the ordinary construction of cardboard boxes.

A model aircraft in accordance with the principles of this invention may be manufactured with great ease and simplicity and yet provide an attractive, strong and good-performing aircraft. Furthermore, it will be clear to those skilled in the art that construction according to this invention is not limited to the use of corrugated cardboard but may equally well apply to other materials which can be printed and stamped. For example, it would be possible to utilize sheet plastic or corrugated plastic to form the fuselage and/or wings of the aircraft. Other variations will occur to those skilled in the art so that many interesting and exciting model aircraft will likely be constructed in accordance with the teachings of this invention.

What is claimed is:

1. A model aircraft of a material having therein a plurality of parallel channels, said aircraft comprising:
an airframe of said material;
a pair of wings of said material having the parallel channels therein running spanwise; and
a plurality of elongated spring-like elements fitted to each wing to join the wings together.

2. A model aircraft as in claim 1 wherein the spring-like elements are bent at a predetermined dihedral angle, whereby the wings are joined together at said dihedral angle.

3. A model aircraft as in claim 1 wherein the spring-like elements are fitted to each wing by lengthwise insertion into certain of said parallel channels.

4. A model aircraft comprising:
an airframe;
an airfoil in contact with the airframe at at least one pivot point; and
wing saddle means in the airframe for cooperating with the airfoil to cantilever external forces on the airfoil about said at least one pivot point and carry said forces to the airframe.

5. A model aircraft as in claim 4 wherein:
the airfoil shape includes a predetermined dihedral angle; and
the wing saddle means includes a surface bent at said dihedral angle for providing a seat for the airfoil internal to the airframe.

6. A model aircraft as in claim 1 further comprising:
a plurality of ribs for defining an airfoil shape of each wing, the airfoil shape being determined by bending each wing over the ribs, the trailing edge of each wing being formed in a forward swept configuration so that the airfoil shape acquires an increasing downward rotation as a function of increasing distance from the center of the wing to the wing tip when the wing is bent over the ribs.

7. A model aircraft as in claim 6 wherein the ribs are configured to provide alignment of the wings by alignment of a straight surface of each rib with a corresponding surface of the other ribs.

8. In a model aircraft, an airfoil comprising:
a plurality of rib elements for defining an airfoil shape;
a forming element of a material having on one side a plurality of parallel channels, said forming element being stretched around said plurality of rib elements with said channels facing away from said rib elements; and
a covering sheet stretched around said forming element.

9. A model aircraft and integral package therefor comprising a sheet of fabricating material, including a plurality of panels, selected panels having indicated thereon the shape of elements of said aircraft, the panels being folded one on another to form said package.

10. A model aircraft and integral package as in claim 9 wherein the shape of the elements of said aircraft is partially cut through the fabricating material to provide easy removal of the elements from the panels of the package.

11. A model aircraft and integral package as in claim 9 wherein certain ones of the panels have imprinted thereon graphics comprising external front and rear panels of said package.

12. A model aircraft as in claim 11 wherein other ones of the panels have imprinted thereon assembly instructions for said aircraft.

* * * * *